US011594210B1

(12) United States Patent
Arquette

(10) Patent No.: US 11,594,210 B1
(45) Date of Patent: Feb. 28, 2023

(54) DIGITAL AUDIO METHOD FOR CREATING AND SHARING AUDIO BOOKS USING A COMBINATION OF VIRTUAL VOICES AND RECORDED VOICES, CUSTOMIZATION BASED ON CHARACTERS, SERIALIZED CONTENT, VOICE EMOTIONS, AND AUDIO ASSEMBLER MODULE

(71) Applicant: Brett Duncan Arquette, Orlando, FL (US)

(72) Inventor: Brett Duncan Arquette, Orlando, FL (US)

( * ) Notice: Subject to any disclaimer, the term of this patent is extended or adjusted under 35 U.S.C. 154(b) by 0 days.

(21) Appl. No.: 17/406,566

(22) Filed: Aug. 19, 2021

Related U.S. Application Data

(63) Continuation of application No. 16/271,268, filed on Feb. 8, 2019, now abandoned.

(51) Int. Cl.
*G10L 13/00* (2006.01)
*G10L 13/047* (2013.01)
*G10L 13/07* (2013.01)

(52) U.S. Cl.
CPC ..... *G10L 13/00* (2013.01); *G10L 13/047* (2013.01); *G10L 13/07* (2013.01)

(58) Field of Classification Search
USPC ..... 704/1–504
See application file for complete search history.

(56) References Cited

U.S. PATENT DOCUMENTS 5,708,825 A * 1/1998 Sotomayor ..... G06F 40/30 707/E17.094
5,963,205 A * 10/1999 Sotomayor ..... G06F 16/748 715/236
6,961,895 B1 * 11/2005 Beran ..... G09B 5/06 715/203
7,020,663 B2 * 3/2006 Hay ..... G06Q 30/06 707/999.102
8,792,818 B1 * 7/2014 Colebank ..... G09B 5/062 704/275
9,449,523 B2 * 9/2016 Dougherty ..... G09B 5/062
10,347,238 B2 * 7/2019 Jin ..... G10L 21/00
10,679,605 B2 * 6/2020 Gruber ..... G10L 13/00
2002/0184189 A1 * 12/2002 Hay ..... G06Q 50/20

(Continued)

*Primary Examiner* — Marcus T Riley
(74) *Attorney, Agent, or Firm* — Terry M. Sanks, Esq.; Beusse Sanks, PLLC

(57) ABSTRACT

A method includes receiving a text file of an author's book as input to a serialized process that creates a record of each paragraph of text and creating a character file with associated character attributes and information required for the recording process and or virtualization process. The method includes combining the serialized file with the character file to create a snippet file, assigning characters to snippets, and generating audio files from snippets using text-to-speech APIs. The snippets of text are assigned to a character, can be edited and audio played back. The method includes sharing snippets with narrators to record specific characters not represented by text-to-speech synthesized audio and concatenating all audio files from snippets, with proper time spacing, into a publishable audiobook format. The snippets are concatenated, and audio files are created through links to text-to-speech API processes. The snippets are concatenated and shared with a human narrator.

20 Claims, 20 Drawing Sheets

| Name | Age | Voice Tone | Color | InfColor | Physicaldesc | Personalitydesc | CharNickName1 | CharNickName2 | SoundName | SoundLoads | Sex | RecLock |
|---|---|---|---|---|---|---|---|---|---|---|---|---|
| Marshall Hall | 43 | Deep,Husky | Coral | White | Tall, 25lbs,han... | traumatized over... | Skipper | Captain | Mathew:Eng/M | 02000 | M | Unlocked |
| Kara Ramey | 29 | Cool, sexy | LightPink | Black | dfgdfg | dfgdfg | dfgdfg | dfgdfg | Joanna:Eng/F/ | 00000 | F | Unlocked |
| Jarrel Pepper | 49 | New York so... | LightGreen | Black | sdsdfgsd | trhsdrthdrht | drthdfth | dfghrdht | Joey:Eng/M/Hi | 140000 | M | Unlocked |
| General Ford | 62 | Deep,loud,te... | Cornsilk | Black | we | wersdf | sefsef | sefaef | Mathew:Eng/M | 20000 | M | Unlocked |
| Janice Weston | 48 | Slight souther... | Black | White | sdfgsdf | sdfgdsfg | dsfgdsfg | sdfgsdfg | Kimberly:Eng/F/ | 00000 | F | Locked |
| Forwan Shallah | 35 | Rugged terrorist | LightSeaGreen | Black | 180lbs dressed in... | Love his family, hi... | Papa | asdf | Joey:Eng/M/Low | 00000 | M | Locked |
| Climber Tourest | 30 | N/A | LightSteelBlue | Black | n/a | n/a | n/a | asdfasd | Russell:Aus/M/L | 00000 | M | Unlocked |
| Narrator | N/A | N/A | DarkGreen | White | N/A | N/A | N/A | asdf | Brian:Brit/M/Low | 00000 | M | Unlocked |
| Alex Knox | 16 | Voice breaking | Salmon | Yellow | N/A | N/A | N/A | N/A | Justin:Eng/M/Kid | 00000 | M | Unlocked |
| Store Clerk | N/A | N/A | DarkGreen | White | N/A | N/A | N/A | N/A | Joey:Eng/M/Med | 12000 | M | Unlocked |
| Dallas Stone | N/A | N/A | Azure | BlueViolet | N/A | N/A | N/A | N/A | Justin:Eng/M/Kid | 00000 | M | Unlocked |
| Paige Grayson | N/A | N/A | DarkMagenta | White | N/A | N/A | N/A | N/A | Nicole:Aus/F/Low | 00000 | F | Unlocked |
| Gage Renner | N/A | N/A | CornflowerBlue | Yellow | N/A | N/A | N/A | N/A | Mathew:Eng/M/... | 00000 | M | Unlocked |
| Sara Starling | N/A | N/A | Chartreuse | Black | N/A | N/A | N/A | N/A | Kendra:Eng/F/Hi | 00000 | F | Unlocked |
| Forwan Solider 1 | N/A | N/A | DarkOrange | Select Color | N/A | N/A | N/A | N/A | Joey:Eng/M/Med | 12000 | M | Unlocked |
| Paul Moore | N/A | N/A | LightSlateGray | Yellow | N/A | N/A | N/A | N/A | Russell:Aus/M/L | 00000 | M | Unlocked |
| Karen Wesley | N/A | N/A | LightGray | Select Color | N/A | N/A | N/A | N/A | Joanna:Eng/F/L | 02000 | F | Unlocked |
| Marcus Walker | N/A | N/A | LavenderBlush | Select Color | N/A | N/A | N/A | N/A | Geraint:Wel/M/ | 00000 | M | Unlocked |
| Topher | N/A | N/A | DarkCyan | White | N/A | N/A | N/A | N/A | Joey:Eng/M/Med | 12000 | M | Unlocked |
| Damon Hooper | N/A | N/A | LightSalmon | Select Color | N/A | N/A | N/A | N/A | Mathew:Eng/M | 00000 | M | Unlocked |
| Boys Mother | N/A | N/A | DarkOrange | Select Color | N/A | N/A | N/A | N/A | Geraint:Wel/M/ | 00000 | F | Unlocked |

(56) References Cited

U.S. PATENT DOCUMENTS

| | | | | |
|---|---|---|---|---|
| 2002/0193994 | A1* | 12/2002 | Kibre | G10L 13/047 704/260 |
| 2006/0277060 | A1* | 12/2006 | Antognini | G06Q 10/10 715/730 |
| 2007/0005616 | A1* | 1/2007 | Hay | G06Q 50/20 |
| 2009/0262907 | A1* | 10/2009 | Arquette | H04M 3/42221 379/88.14 |
| 2014/0007257 | A1* | 1/2014 | Dougherty | G09B 5/062 726/28 |
| 2015/0127340 | A1* | 5/2015 | Epshteyn | G10L 21/00 704/235 |
| 2015/0278298 | A1* | 10/2015 | Boldyrev | G06F 16/245 707/769 |
| 2017/0060857 | A1* | 3/2017 | Imbruce | G06T 13/00 |
| 2019/0043474 | A1* | 2/2019 | Kingsbury | G10L 13/10 |
| 2020/0211531 | A1* | 7/2020 | Kumar | G10L 13/00 |
| 2020/0258495 | A1* | 8/2020 | Arquette | G10L 13/07 |
| 2021/0241753 | A1* | 8/2021 | Kumar | G10L 13/02 |

* cited by examiner

CoLabNarration-Character Manager

Character Manager UI 200

Back to Snippet Manager | Save | Selected File

| 201 Name | 202 Age | 203 Voice Tone | 204 Color | 205 IntColor | 206 Physicaldesc | 207 Personalitydesc | 208 CharNickName1 | 209 CharNickName2 | 210 SoundName | 211 SoundMods | 212 Sex | 213 RecLock |
|---|---|---|---|---|---|---|---|---|---|---|---|---|
| Marshall Hail | 43 | Deep,Husky | Coral | White | Tall, 250lbs,han... | traumatized over... | Skipper | Captain | Mathew:Eng/M | 02000 | M | Unlocked |
| Kara Ramey | 29 | Cool, sexy | LightPink | Black | dfgdfg | dfgdfg | dfgdfg | dfgdfg | Joanna:Eng/F/ | 00000 | F | Unlocked |
| Jarret Pepper | 49 | New York so... | LightGreen | Black | sdsdfgsd | trhsdrthdrht | drthdfth | dfghrdht | Joey:Eng/M/Hi | 140000 | M | Unlocked |
| General Ford | 62 | Deep,loud,te... | Cornsilk | Black | we | wersdf | sefsef | sefaef | Mathew:Eng/M | 20000 | M | Unlocked |
| Janice Weston | 48 | Slight souther... | Black | White | sdfgsdf | sdfgdsfg | dsfgdsfg | sdfgsdfg | Kimberly:Eng/F/ | 00000 | F | Locked |
| Farwan Shallah | 35 | Rugged terrorist | LightSeaGreen | Black | 180lbs dressed in... | Love his family, hi... | Papa | asdf | Joey:Eng/M/Low | 00000 | M | Locked |
| Climber Tourest | 30 | N/A | LightSteelBlue | Black | n/a | n/a | n/a | asdfasd | Russell:Aus/M/L | 00000 | M | Unlocked |
| Narrator | N/A | N/A | DarkGreen | White | N/A | N/A | N/A | asdf | Brian:Brit/M/Low | 00000 | M | Unlocked |
| Alex Knox | 16 | Voice breaking | Salmon | Yellow | N/A | N/A | N/A | N/A | Justin:Eng/M/Kid | 00000 | M | Unlocked |
| Store Clerk | N/A | N/A | DarkGreen | White | N/A | N/A | N/A | N/A | Joey:Eng/M/Med | 12000 | M | Unlocked |
| Dallas Stone | N/A | N/A | Azure | BlueViolet | N/A | N/A | N/A | N/A | Justin:Eng/M/Kid | 00000 | M | Unlocked |
| Paige Grayson | N/A | N/A | DarkMagenta | White | N/A | N/A | N/A | N/A | Nicole:Aus/F/Low | 00000 | F | Unlocked |
| Gage Renner | N/A | N/A | CornflowerBlue | Yellow | N/A | N/A | N/A | N/A | Mathew:Eng/M... | 00000 | M | Unlocked |
| Sara Starling | N/A | N/A | Chartreuse | Black | N/A | N/A | N/A | N/A | Kendra:Eng/F/Hi | 00000 | F | Unlocked |
| Farwan Solider 1 | N/A | N/A | DarkOrange | Select Color | N/A | N/A | N/A | N/A | Joey:Eng/M/Med | 12000 | M | Unlocked |
| Paul Moore | N/A | N/A | LightSlateGray | Yellow | N/A | N/A | N/A | N/A | Russell:Aus/M/L | 00000 | M | Unlocked |
| Karen Wesley | N/A | N/A | LightGray | Select Color | N/A | N/A | N/A | N/A | Joanna:Eng/F/L | 02000 | F | Unlocked |
| Mocus Walker | N/A | N/A | LavenderBlush | Select Color | N/A | N/A | N/A | N/A | Geraint:Wel/M/ | 00000 | M | Unlocked |
| Topher | N/A | N/A | DarkCyan | White | N/A | N/A | N/A | N/A | Joey:Eng/M/Med | 12000 | M | Unlocked |
| Damon Hooper | N/A | N/A | LightSalmon | Select Color | N/A | N/A | N/A | N/A | Matthew:Eng/M | 00000 | M | Unlocked |
| Boys Mother | N/A | N/A | DarkOrange | Select Color | N/A | N/A | N/A | N/A | Geraint:Wel/M/ | 00000 | F | Unlocked |

FIG. 2

CoLabNarration-Snippet Manager

Snippet Manager UI_300

File Edit Show

Look Text | Delete Row | Re-Paint | Sync Rec

| 301 Character | 302 Text_Block | 303 Snip_Type | 304 Rec | 305 Est_Dur | 306 Act_Dur | 307 About | 308 Language | 309 Ver | 310 Char_Voice |
|---|---|---|---|---|---|---|---|---|---|
| Narrator | Hail Strike | Book Title | REC | 1 | 2 | View Char | English | 1 | None |
| Narrator | Written by Brett Arquette | Publishing Info | REC | 1 | 2 | View Char | English | 1 | None |
| Narrator | Dedicated to my Daughter Holly. A father couldn't be more proud and impressed than I am with you! I smile because you are my daughter. | Dedication | REC | 2 | 3 | View Char | English | 1 | None |
| Narrator | PROLOGUE | Chapter Title | REC | 1 | 1 | View Char | English | 1 | None |
| Narrator | PORT AUTONOME DE LOMÉ–LOMÉ,TOGO | Chapter Title | REC | 2 | 4 | View Char | English | 1 | None |
| Narrator | The cargo ship, Hail Proton, was docked in Lome, Togo. The crew was unaware that they were under intense scrutiny and surveillance–by a rat. Like most rats, this rat was hungry. From the darkness of the small drainage pipe, the rodent watched as a large door opened on the dock level. It watched the men load tons of food onto the large ship. A forklift was busy making a procession of back-and-forth trips from the truck to the ship, delivering what seemed to be endless pallets of wonderful-smelling food the rat would love to sink its tiny yellow teeth into. The rat stuck its furry head out of the drainpipe and tentatively lifted its wet nose into the air. It inhaled deeply and salivated at the smells of seafood, produce, meat and many other wonderful aromas wafting on the night air. The rat hesitated, contemplating making a break for the cavernous opening on the side of the ship. But deep down | Narration | REC | 84 | 78 | View Char | English | 1 | None |

FIG. 3

FIG. 4A | FIG. 4B

FIG. 4

CoLabNarration-Snippet Manager Snippet Manager UI 400

File Edit Show

| Text_Block | Snip_Type | Rec | Est_Dur | Act_Dur |
|---|---|---|---|---|
| nd then was the sound of the bar retracting on e iron door and a moment later Marshall Hail ed the room. He walked over to the young adults and pointed at their project. He asked, | Narration | NO | 12 | 0 |
| What in the heck is that? | Narration | NO | 1 | 0 |
| ought it looked like a smaller version of NASA's n space capsule. On the side facing Hail, near bottom of the capsule, he could make out two istant square openings. In one of the openings, a metal door of some type was half closed. | Narration | NO | 16 | 0 |
| son got to her feet, and with an elegant wave of her hand, said, | Narration | NO | 4 | 0 |
| would like to introduce you to the Jefferson Starship. | Dialogue | NO | 3 | 0 |
| made a face. Not really a look of disapproval, more like a look of disbelief. | Narration | NO | 5 | 0 |
| you guys told me you wanted to make a drone, ought you were talking about something small. This...this- | Dialogue | NO | 7 | 0 |
| Hail searched for the right word. | Narration | NO | 2 | 0 |
| This Starship. | Dialogue | NO | 1 | 0 |
| Too late. | Dialogue | NO | 1 | 0 |
| Alex Knox said. | Narration | NO | 1 | 0 |

<

FIG. 4A

Snippet Manager UI 400

Look Text | Delete Row | Re-Paint | Sync Rec

| About | Language (307) | Ver (401) | Char_Voice (402) | Snip_Emotion (403) | ID |
|---|---|---|---|---|---|
| View Char | English | 1 | None | Narration | 005790 |
| View Char | English | 1 | Mathew: Eng/M/Low | Confused 406 | 005800 |
| View Char | English | 1 | None | Narration | 005810 |
| View Char | English | 1 | None | Narration | 005820 |
| View Char | English | 1 | Nicole: Aus/F/Low | Confident 406 | 005830 |
| View Char | English | 1 | None | 00000 | 005840 |
| View Char | English | 1 | Mathew: Eng/M/Med | Confused 406 | 005850 |
| View Char | English | 1 | 00000 | Narration | 005860 |
| View Char | English | 1 | Mathew: Eng/M/Low | Disappointed 406 | 005870 |
| View Char | English | 1 | Justin: Eng/M/Kid | Disappointed 406 | 005880 |
| View Char | English | 1 | 00000 | Narration | 005890 |

406

Spiteful
Elated
Shocked
Overwhelmed
Helpless
Vengeful
Enthusiastic
Exhilarated
Uncomfortable
Isolated
Disliked
Optimistic
Dismayed
Guilty
Numb
Resentful
Elated
Amazed
Hurt
Regretful
Trusting
Delighted
Confused
Lonely
Ambivalent
Alienated
Calm
Stunned
Melancholy
Exhausted
Bitter
Relaxed
Interested
Depressed
Insecure
Insulted
Relieved
Intrigued
Hopeless
Disgusted
Indifferent

FIG. 4B

Concatenate Audio in Audiobook UI 600

CoLabNarration-Make Audiobook 601 602

Making Audiobook... Version 1 2 Mixed Recorded and Virtual Voices working on joining snippet number 000010
working on joining snippet number 000020
working on joining snippet number 000030
working on joining snippet number 000040
working on joining snippet number 000050
working on joining snippet number 000060
working on joining snippet number 000070
working on joining snippet number 000080
working on joining snippet number 000090
working on joining snippet number 000100
working on joining snippet number 000110
working on joining snippet number 000120
working on joining snippet number 000130
working on joining snippet number 000140
working on joining snippet number 000150
working on joining snippet number 000160
working on joining snippet number 000170
working on joining snippet number 000180
working on joining snippet number 000190
working on joining snippet number 000200
working on joining snippet number 000210
working on joining snippet number 000220
working on joining snippet number 000230
working on joining snippet number 000240
working on joining snippet number 000250
working on joining snippet number 000260
working on joining snippet number 000270
working on joining snippet number 000280
working on joining snippet number 000290
working on joining snippet number 000300
working on joining snippet number 000310

Pause Next Cancel

FIG. 6

Recording Mode #1 U1100

1101 1102 1103

Hail Strike Brett Arquette

Hail began the conversation, "Good afternoon, Madam President—I mean, Joanna. I hope I'm not interrupting you, but we need to talk."

From Marshall Hail's perspective, the POTUS looked understandably upset. Her first words verified his assumption.

"How in the *Hell* were you able to land this—this—contraption on my table? Do you have any idea what extensive measures we have taken to prevent this from continually occurring?"

The President pointed up to the glass roof and sternly continued, "We installed opaque glass over the garden to prevent you or anyone else, from using lasers to pilot drones onto the White House property."

Hail sensed that even though the President had run out of words, her tirade had not yet diffused her anger. She was still fuming.

Doing a remarkable job of hiding his personal amusement, Hail meekly replied, "Well, the drone keeps track of the exact X and Y coordinates of its last landing spot, so it doesn't require communication with anything in order to return. But, if you had moved the table, it might have—"

The President was no longer listening. She threw her hands up in the air and looked up at the glass dome. She shook her fists and yelled, "Mr. Hail, you are really trying my patience! Do you have any idea how much your drone's unscheduled visits are costing the taxpayers?"

Hail shrugged and said, "If it makes your staff take more security precautions I am doing my civic duty."

The President made a face Hail thought looked a little angry, a little frustrated, and a whole lot overwhelmed.

In a tone that sounded like a woman who was trying to get rid of Hare Krishnas who had knocked on her front door, the president asked, "Why are you sitting on my table yet again, Marshall?"

Hail was pleased to get down to business. "It's really no big deal. I just need two things: First, I need the names of the Marines I got in trouble and their contact information."

FIG. 11

CoLabNarration-Snippet Manager

Recording Mode #2 UI_1200

File Edit Show

Look Text | Delete Row | Re-Paint | Sync Rec

| Character | Text_Block | Snip_Type | Rec | Est_Dur | Act_Dur | About | Language | Ver | Char_Voice |
|---|---|---|---|---|---|---|---|---|---|
| Narrator | Hail Strike | Book Title | REC | 1 | 2 | View Char | English | 1 | None |
| Narrator | Written by Brett Arquette | Publishing Info | REC | 1 | 2 | View Char | English | 1 | None |
| 1201 Narrator 1201 | Dedicated to my Daughter Holly. A father couldn't be more proud and impressed than I am with you! I smile because you are my daughter. | Dedication | REC | 2 | 3 | View Char | English | 1 | None |
| Narrator | PROLOGUE | Chapter Title | REC | 1 | 1 | View Char | English | 1 | None |
| Narrator | PORT AUTONOME DE LOMÉ–LOMÉ,TOGO | Chapter Title | REC | 2 | 4 | View Char | English | 1 | None |
| 1201 Narrator | The cargo ship, Hail Proton, was docked in Lome, Togo. The crew was unaware that they were under intense scrutiny and surveillance–by a rat. Like most rats, this rat was hungry. From the darkness of the small drainage pipe, the rodent watched as a large door opened on the dock level. It watched the men load tons of food onto the large ship. A forklift was busy making a procession of back-and-forth trips from the truck to the ship, delivering what seemed to be endless pallets of wonderful-smelling food the rat would love to sink its tiny yellow teeth into. The rat stuck its furry head out of the drainpipe and tentatively lifted its wet nose into the air. It inhaled deeply and salivated at the smells of seafood, produce, meat and many other wonderful aromas wafting on the night air. The rat hesitated, contemplating making a break for the cavernous opening on the side of the ship. But deep down | Narration | REC | 84 | 78 | View Char | English | 1 | None |

FIG. 12

FIG. 13 | FIG. 13A | FIG. 13B

CoLabNarration-Listen to Audio

Listen to Audio UI 1300

Start Num: 100 End Num: 300 1301 1303 Listen Clear ☑ Delay

1301 Snip ID: 43330 (Number of Records: 4302) Snippet Manager

Conversion Info

Character Name: Narrator Snippet Emotion: Narrative Snippet Type: Narration

Character Voice: Brian Bri/Med Snippet Number 100 Audio File Name: 100-Hail Strike Playing file: 100-HailStrike.mp3

Text Block

The cargo ship, Hail Proton, was docked in Lome, Togo. The crew was unaware that they were under intense scrutiny and surveillance--by a rat. Like most rats, this rat was hungry. From the darkness of the small drainage pipe, the rodent watched as a large door opened on the dock level. It watched the men load tons of food onto the large ship. A forklift was busy making a procession of back--and--forth trips from the truck to the ship, delivering what seemed to be endless pallets of wonderful--smelling food the rat would love to sink its tiny yellow teeth into. The rat struck its furry little head out of the drainpipe and tentatively lifted its wet nose into the air. It inhaled deeply and salivated at the smells of seafood, produce, meat and many other wonderful aromas wafting on the night air. The rat hesitated, contemplating making a break for the cavernous opening on the side of the ship. But deep down instinct warned that it would never make it. One of the men responsible for the loading of the ship might see it, and it would be "lights out" for the rat once it met the business end of either a broom or stick. But more than likely, within this less populated and violent country of Togo, a man brandishing a gun would accomplish the rat's demise. 1304

Select Specific Characters to Listen to ☒

Add All Male | Add All Female | Clear All

Marshall Hail
Kara Ramey
Jarret Pepper
General Ford
Janice Weston
Farwan Shallah
Climber Tourest
Narrator
Alex Knox
Store Clerk
Dallas Stone
Paige Grayson
Gage Renner
Sara Starling
Farwan Solider 1
Paul Moore
Karen Wesley
Macus Walker
Topher
Damon Hooper
Boys Mother
Young Naveed
Young Zain Narrator
Marshall Hail
Paige Grayson

1302

1302

FIG. 13A

FIG. 14 | FIG. 14A | FIG. 14B

Method to Share the Project with a Narrator UI 1400

CoLabNarration-Share Project with a Narrator

Snippet Manager

Add | Remove | Save | Unlock Code (1413) A6578 | Send (1410)

Select Specific Characters to Listen to

Add All Male | Add All Female | Clear All

Narrators

| Narrator Name (1401) | Sex (1402) | Voice Type (1403) | Voice Age (1404) | Language (1405) | Accent (1406) | Email Address (1407) | ACX URL (1409) |
|---|---|---|---|---|---|---|---|
| Michael Reaves | M | Husky | 30s | English | None | ssmithreaves@gmail.com | https://www.acx.com/narrator?p=A2DHRU422W5BYV |
| Virginia Gallagher | F | Clear | 25 | English | British | vgallager@gmail.com | https://www.acx.com/narrator?p=A2B38RJOH08530 |
| Dini Steyn | F | Low | 40 | German | German | dsteyn@gmail.com | https://www.acx.com/narrator?p=A339806LPAEX4N |
| Mike Carbuccio | M | Scratchy | 35 | French | French | mcarbuccio@gmail.com | https://www.acx.com/narrator?p=A3U2PMPBOTCB |
| Aminah Shahid | F | Young girl | 9 | English | British | ashahid@gmail.com | https://www.acx.com/narrator?p=AN8WKEXP21BB5 |

Marshall Hall (1411)
Kara Ramey (1412)
Jarret Pepper
General Ford
Janice Weston
Farwan Shallah
Climber Tourest
Narrator
Alex Knox
Store Clerk
Dallas Stone
Paige Grayson
Gage Renner
Sara Starling
Farwan Solider 1
Paul Moore
Karen Wesley
Macus Walker
Topher
Damon Hooper
Boys Mother
Young Naveed
Young Zain

>>>

Marshall Hall
Jarret Pepper
General Ford
Farwan Shallah
Climber Tourest
Narrator
Alex Knox
Store Clerk
Dallas Stone
Gage Renner
Farwan Solider 1
Paul Moore
Macus Walker
Topher
Damon Hooper
Young Naveed
Young Zain
Nolan
Victor Komev
Rodgers
Spearman
Naveed Man
Zain Man

FIG. 14A

Method Email a Shared Narrator Receives 1500

From: Brett Arquette <brett@arquette.us>*
Subject: Sharing CoLabNarration Project - HailStrike from Brett Arquette 1501
To: Me <bjunk@arquette.us>*

---

Greetings Dini Steyn,

Author Brett Arquette has shared his new novel HailStrike with you.

You can import this project into your CoLabNarration application by downloading the file from this link:

1502 http://docs.aws.amazon.com/aws-sdk-php/latest/class-Aws.$3.$3Client.html#_getObjectUrl

---

Once you have imported this project into your CoLabNarration software, use the following code to unlock the characters that were assigned to you.

Unlock Code: A6587

Project Info: 1503

Number of characters assigned to you: 29
Estimate recording duration of all characters: 2.9 hours.
Expected Due Date: 12/01/2019

After you are done with your project, use the Export function to sent the project back to the author.

**Thanks for using CoLabNarration "*The future of audio books is here!*"**

If you haven't downloaded CoLabNarration, then you can do so at the following link.

1504 http://docs.aws.amazon.com/aws-sdk-php/latest/class-Aws.$3.$3Client.html#_getObjectUrl

---

FIG. 15

DIGITAL AUDIO METHOD FOR CREATING AND SHARING AUDIO BOOKS USING A COMBINATION OF VIRTUAL VOICES AND RECORDED VOICES, CUSTOMIZATION BASED ON CHARACTERS, SERIALIZED CONTENT, VOICE EMOTIONS, AND AUDIO ASSEMBLER MODULE

CROSS REFERENCE TO RELATED APPLICATION

This application is a Continuation of U.S. application Ser. No. 16/271,268 filed Feb. 8, 2019, the entirety of which is incorporated by reference.

BACKGROUND

The current way that audiobooks are created is the author or publisher hires a human narrator to read and record the audiobook. The downside to this method is 1) cost of the narrator's time (per finished hour) of the recording 2) If the book is being read by a female and male narrator, then they both have to be in the same room at the same time to record the narration. 3) When two or more narrators are recording the book, they must perform this task in a serialized manner (line after line) which costs all parties in the process more money and time. 4) The author is limited to the number of voices and dialects the narrators can produce 5) The author has no input on how a line in their book should be read, which in this document is referred to as the emotion of the line. 6) A single version of the book is recorded, and the manual process does not lend itself toward creating multiple versions of the audiobook, such as a classroom edition where a second version of a text block without profanity can be recorded as a school-friendly audiobook. 7) The collaborating element of this invention allows the author to hire several narrators and easily share the project via email, where each narrator can record their lines simultaneously from anywhere in the world. For example, an author might have some lines in their book that are written in Spanish. Using the collaborating tools within this invention, this language can be farmed out to a Spanish-speaking narrator. Child-spoken sections of the novel can be farmed out to children narrators (yes, believe it or not, there are children narrators). 8) If an author receives the audio package back from a real narrator and doesn't like the way a particular line was read, the author can request that just that one line be reread and sent to them, eliminating the complex process of the narrator having to use editing software to complete this task.

This method of creating an audiobook is not merely hypothetical. The inventor of the CoLabNarration method has written a production-ready software application. This software walks the author through the process with helpful wizards and intuitive design. The inventor of the CoLabNarration process has used this software to create the first combined text-to-speech and real narrator finished audiobook, in which a sample can be heard at this link:

www.arquette.us/CoLabNarration_example.html

Once the CoLabNarration process has been adopted by authors and publishers, it will allow any author to create their own audiobook for a fraction or the cost. For example, the last audiobook the inventor of the CoLabNarration process wrote cost him $4000 (US) to be read by a human narrator. Contrarily, if the entire book was created by text-to-speech virtual voices, the current cost of using a popular API would cost a total of $2 dollars. Creating a second version would cost an additional 5 cents.

SUMMARY

The popularity and sales of audiobooks has been growing at 16% per year, since many of the younger generation prefers to listen rather than read. This market has been a closed door to authors who cannot afford to hire a narrator to record their books. The CoLabNarration method will allow independent authors to have their work converted to an audiobook for a fraction of the cost and time, and will provide them much more creative control. As time and technology marches forward, text-to-speech voices will become refined to a point where they are indistinguishable from real human voices. At this point, all subsequent audiobooks will be created using the CoLabNarration method. There simply won't be reason to use real narrators, thus eliminating the historical costly method of turning books into audiobooks.

BRIEF DESCRIPTION OF THE DRAWINGS

This detailed description is provided with relevance to the accompanying figures. In the figures, the leftmost digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

FIG. 2 is a screen shot of the Character Manager UI in the CoLabNarration software.

FIG. 3 is a screen shot of the Snippet Manager UI in the CoLabNarration software, where the word Snippet refers to a block of text that has been serialized and displayed on the screen.

FIGS. 4A and 4B are again an actual screen shot of the Snippet Manager UI in the CoLabNarration software, but this view shows the remainder of the fields not included in the previous figure.

FIG. 6 is an actual screen shot that represents the process of concatenating all the audio files into a contiguous audiobook.

FIG. 11 is a screen shot depicting the first of two recording modes that is presented to the human narrator via the Record Mode #1 UI.

FIG. 12 is a screenshot depicting the second of two recording modes that is presented to the human narrator via the Recording Mode #2 UI.

FIGS. 13A and 13B illustrate the Listen to Audio user interface (UI) process that allows the user to listen to audio that has already been recorded or virtualized used by the CoLabNarration method/process.

FIGS. 14A and 14B illustrate the Project Sharing with a Narrator user interface (UI) that allows the author to securely share a project with multiple narrators.

FIG. 15 illustrates the email of a sharing process and illustrates the method in which a narrator would receive and import a CoLabNarration project.

DETAILED DESCRIPTION

Figure 1:
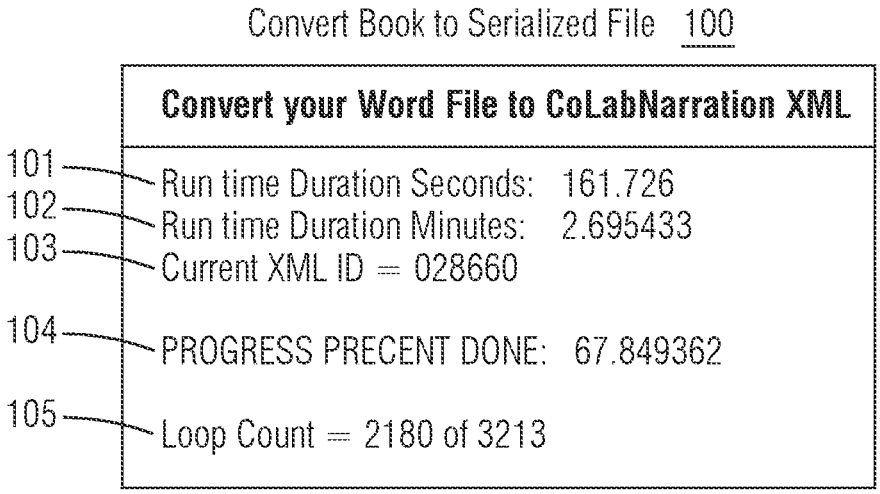
FIG. 1 is a screen shot of the process that converts the text-based book to a file that can be read by the CoLabNarration software.

Today, there is only one method of creating an audiobook. Each word has to be read by a real human narrator, while being recorded, and then edited to create an audiobook.

The Big Five traditional publishers now account for only 16% of the e-books on Amazon's bestseller lists. Accordingly, self-published books now represent 31% of e-book sales on Amazon's KINDLE® Store. Independent authors are earning nearly 40% of the e-book dollars going to authors.

Self-published authors are dominating traditionally published authors in sci-fi/fantasy, mystery/thriller, and romance genres. Independent authors are taking significant market share in all genres, yet very few authors can afford to have their work made into an audiobook. The CoLabNarration method makes it possible for even the poorest of authors to turn their book into an audiobook. This disclosure describes systems and techniques for an author to instigate a process whereas their text book can be made into an audiobook.

The heart of the CoLabNarration process consists of six unique steps. This six-step process or method allows authors to create their own audiobooks with or without humanly recorded narration. The six techniques described herein are:

1) Serialization of the text-based novel or book. This process creates a record for each text paragraph in the book(file) and also creates a proprietary file to be used within the CoLabNarration software application.
2) Creation of a character file. The process allows the author to create a list of characters and add all pertinent information required by the recording process and/or the virtualization process.
3) Combining the serialized file with the character file creates the Snippet file, which is used by the Snippet Manager UI in the CoLabNarration software. In this module, the author can assign characters to every snippet (text block) which will be used in the following step.
4) Generate audio files using 3rd party text-to-speech APIs. Each snippet (text block) is sent to a virtual voice API 1606 (FIG. 16) and converted to an audio file 1608 (FIG. 16).
5) If the author would like snippets recorded by a human narrator, then the author could use the CoLabNarration sharing method to allow multiple narrators to work on the project.
6) Once all the snippets have been converted into audio files and/or all the audio files have been received from the assigned narrator, this final module concatenates all the files, inserts appropriate time delays, and creates the audiobook.

To date, there is no definitive roadmap for authors to create an audiobook using text-to-speech technology, and there are several reasons for this. Authors tend to be left-brain people, who are great at creating wonderful stories and have the fortitude to sit down and turn their ideas into books. The right-brain folks happen to be the technically inclined people who can write code, yet do not have a clue how authors function. You almost have to be an author in order to design the text-to-speech audiobook process for an author. Since the inventor of the CoLabNarration process is both an author, as well as a software coder, he was able to cross the great divide and construct a process realized in his CoLabNarration software. As such, CoLabNarration is a unique audiobook invention created by an author.

Figure 10:
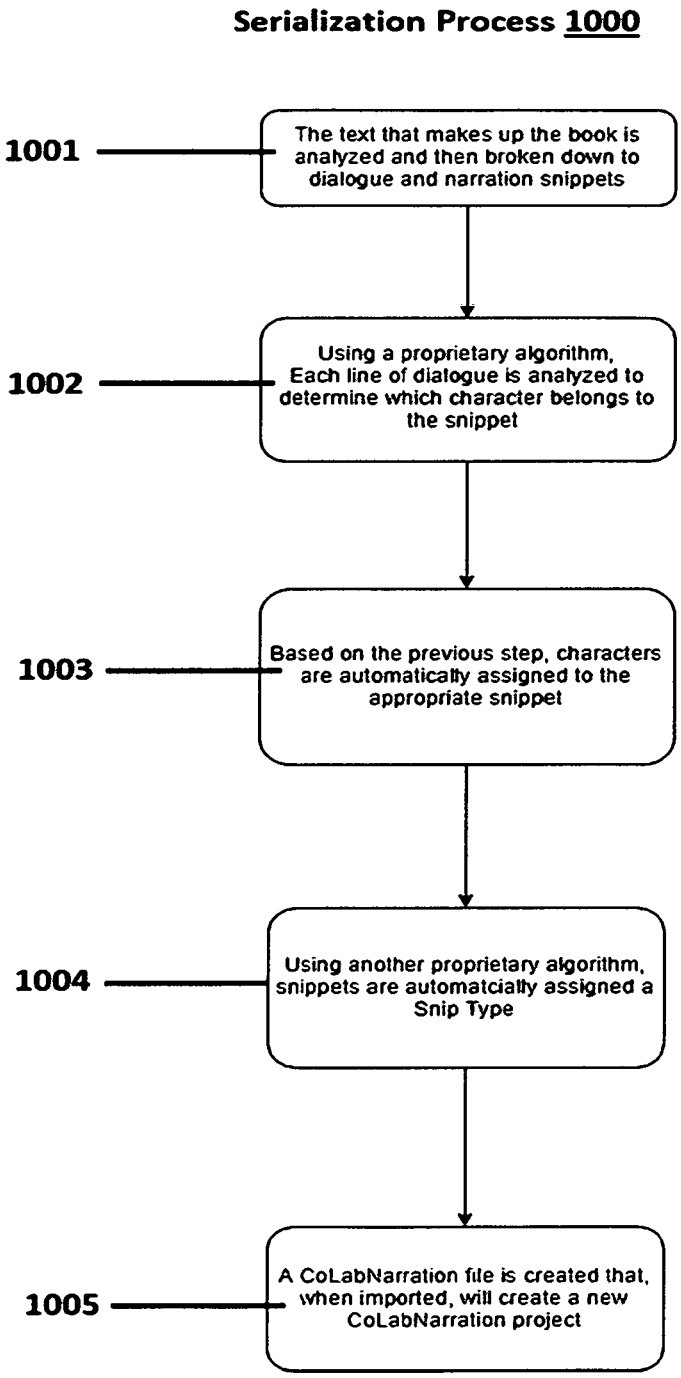
FIG. 10 is a flow diagram depicting the serialization process used to convert a text-based book into a serialize file used by the CoLabNarration method/process.

The user interface responsible for converting the text-based book into a CoLabNarration file is referred to as the serialization process (FIG. 10). The only interaction the author has with this fully automated process, is the selection of their text file to be converted. Once the author has selected the correct file, this module performs a series of complex algorithms which breaks the text file up into individual records that are stored in the snippet file structure. At the end of this process a snippet file has been created. The snippet file is read into the software and automatically opened in the Snippet Manager data grid. Once the Snippet file has been created, the next step for the author is to create the Character file. Inside the Character Manager UI 200 (FIG. 2), the author creates a new character based on each character in their novel. The author is required to fill in some data fields in the Character Manager UI 200 that are critical to the virtualizing and sharing components in later processes. The author can also fill in data elements that may be necessary for a human narrator to record the character. For example, the free form text column VOICE TONE in the Character Manager data grid provides the narrator information such as "New York Accent" or "SHY" or even descriptive phrases such as "RUGGED" or "DEEP". While working inside the Character Manager UI 200 (FIG. 2), the author can assign a character an age, sex, a physical description and a personality description. Since many characters in novels are referred to by a nickname, the author can add up to two nicknames per character, which, for example, might consist of a street name or a colloquialism. In addition, the author can select a background and foreground color for the character, which is also used in the Snippet Manager UI 300/400 (FIGS. 3, 4A and 4B). This color coding of snippets provides the narrator recording the audio the ability to see visual cues of characters they will be recording. The additional fields in the Character table are data elements that are used in the text-to-speech process. The two fields used in the process are Sound Name and Sound Mods (i.e., SoundName field 210 and SoundMods field 211 of FIG. 2). These fields are selected by the author from the dropdown list and mirror names use by specific text-to-speech API services from such companies as GOOGLE® and AMAZON®. For example, the name "Brian" on the AMAZON® Polly API assigns this snippet of text to one of Amazon's text-to-speech characters called "Brian" who speaks with an English accent and speaks in a midlevel tone. The SoundMods field 211 consists of flags that tells the text-to-speech API to return files that are read faster (speed) or higher (tone) or louder (volume). These flags set the tone, speed, and volume for each character, but can be overridden by the Snip_Emotions field 402 in the Snippet Manager UI 400 (FIGS. 4A and 4B). The last field (i.e., Reclock field 213 of FIG. 2) in the Character file allows the author to lock a character, which prevents a second narrator from accidentally recording over a previous recorded snippet. By locking the character, neither the text-to-speech process or human narrator can overwrite previously created audio files.

The function of the Snippet Manager UI 300/400 (FIGS. 3, 4A and 4B) module allows the user to interact with each block of text (snippet). This interface enables the author to edit text, view character information, create different versions of audio, define which text blocks are assigned to a specific character, assign a SnipType, in Snip_Type field 303 to each block, such as Book Title, Publishing Information, Dedication, Chapter, Chapter Break, Dialogue, Narration, and Book End parameters. Within the Snippet Manager UI 300/400 (FIGS. 3, 4A and 4B), the author or narrator is presented with information or visual cues which indicate if the snippet has previously been recorded by either a human narrator or text-to-speech. The Estimated Duration column (i.e., Est_Dur field 305 of FIG. 3)) in the data grid is represented by the number of estimated seconds each text block will take to read. The estimated duration of each block of text (snippet) is calculated in order to provide the author comprehensive project statistics. For clips that have been recorded or created by text-to-speech, the Actual Duration column (i.e., Act_Dur field 306 of FIG. 3) in the data grid represents the true value (in seconds) of the recorded audio file. The Estimate Duration and Actual Duration work in concert, especially when it comes time for an author to select a human narrator. The Estimated Duration provides the author with the estimated time it would take to record each character, all male snippets, all female snippets, as well as and Total Project Duration. An author requires this information in order to estimate how much they will pay a human narrator, prior to choosing a narrator for the assigned snippets. For example, the project's total male minutes might equal two hours, minus the narration text blocks. The author could then approach a human narrator and offer the narrator the job of recording all the male character snippets in the project, with the understanding they will be paid for approximately two finished hours of work. Once the human narrator has recorded all the snippets for each character assigned to him, the Actual Duration would constitute the payable hours from the author to the narrator, which may defer slightly from the estimate duration. Other informational fields in the Snippet Manager UI provides information to a human narrator, indicating that the text block is in English, denoted in the Language column (i.e., Language field 308 of FIG. 3) of the data-grid. The final field (i.e., ID field 403) in the Snippet Manager UI 400 of FIGS. 4A and 4B is referred to as the Snippet Number or Snippet ID. This number is used for data grid navigation, as well as a reference to concatenate audio files in the correct order. During the creation of the snippet file, the text block Snippet IDs are spaced in ten numbered increments in order to allow the author to add up to nine new snippets between each Snippet ID.

The Text-to-Speech Generator UI 500 module allows the author to designate range of Snippet IDs will be recorded using text-to-speech. As an option to using a range designator, the author can also identify specific characters to be rendered via text-to-speech, or all male and/or female characters. The interaction with the text-to-speech API can be visualized on the screen by checking the Delay box 510, which will show each block of text on the screen during the virtualization process. This visual reference provides the author visual feedback of what is taking place. If the Delay box 510 is unchecked, then all of the calls to the text-to-speech API are done behind the scenes which allow the virtualization to run 100-times faster. By benchmarking the text-to-speech turnaround, real world tests indicate the time it takes to convert all the Snippets to audio, for an entire book, can be done in less than two minutes, using the modern text-to-speech APIs. The same length book read by a human narrator could take up to four months to complete.

Prior to the CoLabNarration application and its Project Statistics module, an author who wanted to hire a narrator had no idea how much audio (reflected in seconds) would be read by the human narrator. Therefore, the author had no idea how much the project would cost. The Project Statistics screen calculates the Estimate Duration of all the snippets in the project and breaks it down in total seconds for each character, all male characters, all female characters, as well as isolating the number of seconds to record the narration segments. The module then calculates the duration of the entire project showing Total Project Seconds, Total Project Minutes and Total Project Hours. These statistics enable an author to offer narrators individual characters to record, since the author knows how many estimate seconds each character takes to record.

In the Make Audiobook UI 600 (FIG. 6) module, during the execution of this code most of the heavy lifting is done behind the scenes. Prior to the author clicking the Start button, the author can select which version 601 of the audio book they wish to assemble. By checking the box 602 (FIG. 6) labeled Mixed Recorded and Virtual Voices it tells the program to use human recorded audio files in lieu of text-to-speech audio. If both human recorded and text-to-speech files exist, the text-to-speech files are ignored. Prior to concatenating the audio files, each file is run though a filter that eliminates silent segments in the beginning and end of each audio file. Once this trimming pass has completed, the concatenation process takes place. During this process, the Snippet Type is analyzed, and an appropriate duration of silence is inserted between the files. For example, after a Chapter Title is identified, a full one second segment of silence is insert between the Chapter Title and the next Snippet. In concert with this logic, the last character of each block of text is extracted and analyzed, which again, allows the program the ability to assess the amount of silence that should be inserted between snippets. For example, if a 'comma' is the last character of the text block and the text block type is 'Dialogue' then a very short .25 second of silent audio is inserted to separate the audio snippets. If a 'period' is the last character of the text block, then a .75 second of silence is inserted between then audio snippets. This intuitive spacing of audio snippets ensures that the concatenated audio flows naturally and has the proper cadence.

In the description below, techniques for creating an audiobook in the context of creating text-to-speech and human recorded audio are defined:

Term Examples

"CoLabNarration and CoLabNarration process" refers to the six methods and techniques described within this invention.

"Project" refers to each individual book that is ingested into the CoLabNarration application.

"Project Statistics" describes character seconds, male seconds, female seconds, narration seconds, and total project seconds.

"Text-to-Speech Generator" describes the module responsible for performing the text-to-speech (virtualization) operations.

"Actual Total Project Duration" describes the total number of seconds, minutes, and hours of a project.

"Estimate Total Project Duration" describes the estimate total number of seconds, minutes, and hours of a project.

"Text block" refers to individual blocks of text that form snippets.

"Data-grid" describes the way data is presented in both the Snippet, Narrator, and Character Manager UI.

"Module" describes a UI that allows the author to perform various functions.

"Snippet or Snip" describes a serialized block of text contained within the Snippet file structure.

"Snippet Manager" refers to the software module UI that manages Snippets.

"Snippet File" refers to the backend data structure and specifically denotes the file used in the Snippet Manager.

"Snippet number or ID" refers sequential number structure, whereas each Snippet is assigned to a numerical ID.

"Audio Snippet" describes a block of audio assigned to the Snippet that has been recorded or created using text-to-speech. (Also referred to as "Snip").

"Virtualization process" describes the process or method for creating virtualized (text-to speech) audio files.

"Recording process" describes the process or method for creating human recorded audio files.

"Emotion of the line" refers to a field within the Snippet Manager file structure and denotes the emotion of the line using descriptive words and phrases.

"Character Manager" refers to a UI module that allows authors to control Character content.

"Character file" refers to the backend data structure and specifically denotes the file used in the Character Manager.

"Narrator Manager" refers to a UI module that allows authors to share the project with multiple narrators.

"Narrator file" refers to the backend data structure and specifically denotes the file used in the Narrator Manager.

"SoundName and SoundMods fields" refers to separate fields located within the Character file.

"Emotion field" refers to the backend data structure and describes the emotion of each snippet.

"Snip_Type field" refers to the backend data structure and describes the type of snippet.

"Language field" refers to the backend data structure and describes the language used in a snippet.

"Narrator" refers to the backend data structure and describes any snippet designated as Narration.

"Active data-grid control" (ADGC) describes the ability to click on a cell in the data-grid and execute an action or event.

"Application programming interface" (API) is a set of routines, protocols, and tools for building software applications. In this submission, all mentions of the API refer to text-to-speech services.

SSML is an acronym, which represents Speech Synthesis Markup Language, an XML-based markup language for speech synthesis applications.

FIG. 1 is a screen shot of the process that converts the text-based book to a file that can be read by the CoLabNarration software.

In FIG. 1, Convert Book to Serialized File Screen 100 is a screen shot of the process that creates a file that can be read by the CoLabNarration software, The fields that are displayed while this process is running include run time duration seconds 101 and run time duration minutes 102 provides the time (in seconds) it took to create the file. The current XML ID 103 displays the current snippet ID that is being processed. The progress percent 104 displays how much of the conversion has taken place. The Loop Count 105 equates to the number of snippets in the project.

Figure 16:
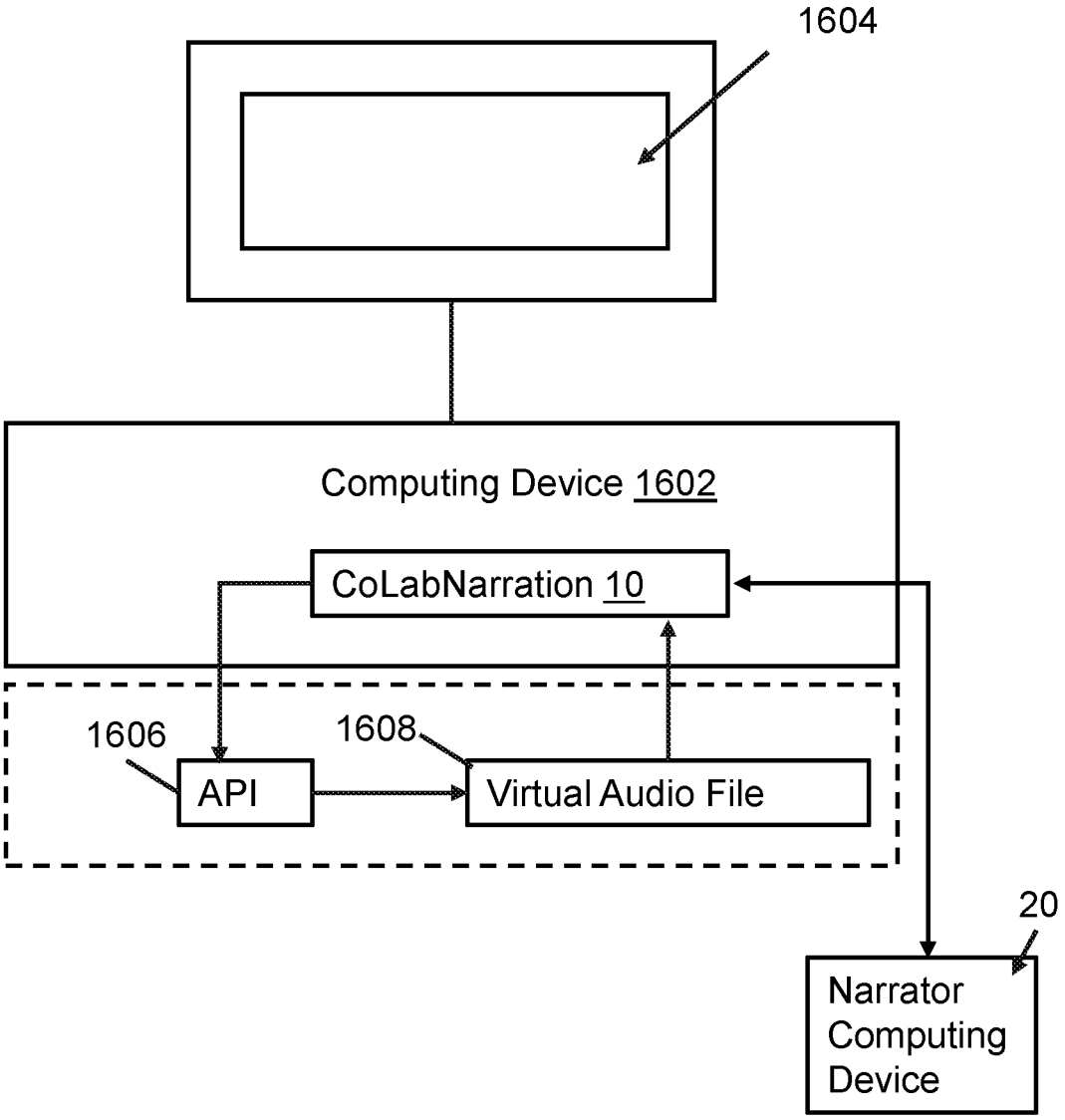
FIG. 16 illustrates a computing device with a screen.

FIG. 2 is a screen shot of the Character Manager UI 200 in the CoLabNarration software 10 (FIG. 16). This figure illustrates the user interface (UI) used to create Characters for the project by adding data elements that are critical to the human recording or text-to-speech process.

In FIG. 2, the Character Manager UI 200, in the CoLabNarration process, allows an author to identify characters from their book and reflect those characters in the project. The Character Manager UI 200 includes a Name field 201, which is an active data-grid control (ADGC) that allows the author to choose the character they wish to associate with a snippet from a dropdown list. The Character Manager UI 200 includes an Age field 202, which is a control that assigns the character's age. The Character Manager UI 200 includes a voice tone field 203, which is a free-form text field that allows that author to describe the tone of the character. The Character Manager UI 200 includes a color field 204, which is an ADGC that allows the author to choose a line color from a dropdown list. The Character Manager UI 200 includes a fntColor field 205, which is similar to the color field, but this ADGC changes the font color of the character. The Character Manager UI 200 includes a Physicaldesc field 206, which is a free form text field that allows the author to describe the physical characteristics of a character. Similar to this field, the Character Manager UI 200 includes a Personalitydesc field 207 allows the author to describe a character's personality. The Character Manager UI 200 includes both a CharNickName1 208 and CharNickName2 209, which are free form text fields that allows the author to provide multiple nicknames for each character. The Character Manager UI 200 includes a SoundName field 210, which allows the author to select a text-to-speech name a list of virtual voices in a dropdown list. Each virtual voicecorresponds to the voice name used in the text-to-speech API. The Character Manager UI 200 includes a SoundMods field 211, which is a collection of parameters that are assigned to a character, based on which SoundName the author selects. These settings control the speed, the tone, and the volume of the character during the virtualization process. These audio characteristics are reflected in the audio file that is returned from the text-to-speech API. The Character Manager UI 200 includes a sex field 212, which allows the author to denote the sex of the character. The Character Manager UI 200 includes a Reclock field 213, which is a binary control that locks and unlocks a specific character, protecting preexisting audio files from being recorded over. This is a preventive measure that is necessary when the project is shared between multiple human narrators.

FIG. 3 is a screen shot of the Snippet Manager UI 300 in the CoLabNarration software 10 (FIG. 16), where the word Snippet refers to a block of text that has been serialized and displayed on the screen 1604 (FIG. 16). This figure illustrates the user interface (UI) for modifying project snippets, as well as adding data elements that are essential to the recording or text-to-speech process.

In FIG. 3, the Snippet Manager UI 300 is an illustration of the data elements returned from the converted book to a serialized project file. The Snippet Manager UI 300 includes a Character field 301, which is an ADGC that allows the author to assign a snippet of audio to a specific character via a dropdown list. Once the character has been assigned, the character's color and font color are reflected in the snippet row. The Snippet Manager UI 300 includes a Text Block field 302, which is a free form text field that contains the text blocks from the author's original text file. This field can be locked or unlocked, which allows the author to change text and then lock it once they are done making modifications. The Snippet Manager UI 300 includes a Snip Type field 303, which is an ADGC the author uses to assign the snippet a specific type. From a dropdown list the author can choose Book Title, Publishing Info, Dedication, Chapter Title, Chapter Break, Narration, Dialogue, and Book End. Each of these items are considered when adding silence between audio segments during the concatenation process. The Snippet Manager UI 300 includes a REC field 304, which is a dual-purpose display that shows the text "REC" when a human narrator has recorded the snippet. The field also turns red in order to provide a visual cue that the snippet has been recorded. The Snippet Manager UI 300 includes an Est_Dur field 305 seeded with the estimated duration of each snippet, which is calculated during the convert a book to a serialized file process. The color of this field turns red when a text-to-speech audio file has been created via the virtualization process. This color change provides a visual reference as to which files have been created by the virtualization process. For clips that have been recorded or created by text-to-speech, the Act_Dur field 306 in the data grid represents the true value (in seconds) of the recorded audio file. The Snippet Manager UI 300 includes a About field 307, which is an ADGC that displays a popup box that contains all the fields for that character from the character file. This provides an author or narrator a fast way to view a specific character's information without leaving the Snippet Manager UI screen.

The Snippet Manager UI 300 includes a Language field 308 is a free-form text field that allows the author to denote what Language is being used in the text block for that snippet. The Snippet Manager UI 300 includes a Ver field 309, which displays the current version of this snippet. The author can create multiple versions of snippets, thereby allowing each concatenation process to build a specific version of the audiobook. For example, there may be snippet with the text, "That's complete bullshit," but the author could copy that snippet, adding a second version of the text block that reads, "That's complete horse-hockey." Versioning also comes into play if an author hires two narrators who are reading the same parts. One human narrator can read all the parts in version one and the second human narrator can read the same snippets as a second version. At this point, the author can decide which narrator did a better job and create the audiobook with the appropriate version. The Snippet Manager UI 300 includes a Character voice field 310, which is an ADGC that allows the author to select a text-to-voice character and apply that voice to the snippet. This field is critical and allows the snippets to be virtualized.

FIGS. 4A and 4B are again a screen shot of the Snippet Manager UI 400 in the CoLabNarration software 10 (FIG. 16), but this view shows the remainder of the fields not included in the previous figure (FIG. 3). In this figure, the horizontal scroll bar has been moved all the way to the left, exposing more fields on the right.

In FIGS. 4A and 4B, the Snippet Manager UI 400 (scroll right fields) is an illustration of the data elements on the right side of the data-grid, returned from the convert book to a serialized project file . Visual references that denote what character belongs to each snippet is reflected in the row and font color 401. While using a human narrator to record snippets, it is important for the narrator to see which character is coming up and the colors are a great visual cue. If a character's colors are changed in the character file, those changes repaint the Snippet Manager data-grid rows with the updated colors. The Snippet Manager UI 400 includes a Snip Emotion field 402, which is selected by the author and is a dual-purpose field. It provides a human narrator the emotion the author is conveying and also is used during the virtualization process using specific parameters that interact with the text-to-speech API. These parameters consist of tone modifications, speed modifications, volume modifications, and also uses SSML keywords, which emphasize words and phrases when the snippets are being virtualized. This combination of text-to-speech parameters works to create emotion within the snippet that is selected. The final field 403 in the Snippet Manager UI 400 is referred to as the Snippet Number or Snippet ID. This number is used for data grid navigation, as well as a reference to concatenate audio files in the correct order. During the creation of the snippet file, the text block Snippet IDs are spaced in ten numbered increments in order to allow the author to add up to nine new snippets between each Snippet ID. The Snippet Manager UI 400 includes a dropdown list 404. In the dropdown list 404, the author is offered more than a hundred emotions that can be assigned to a snippet.

Figure 5:
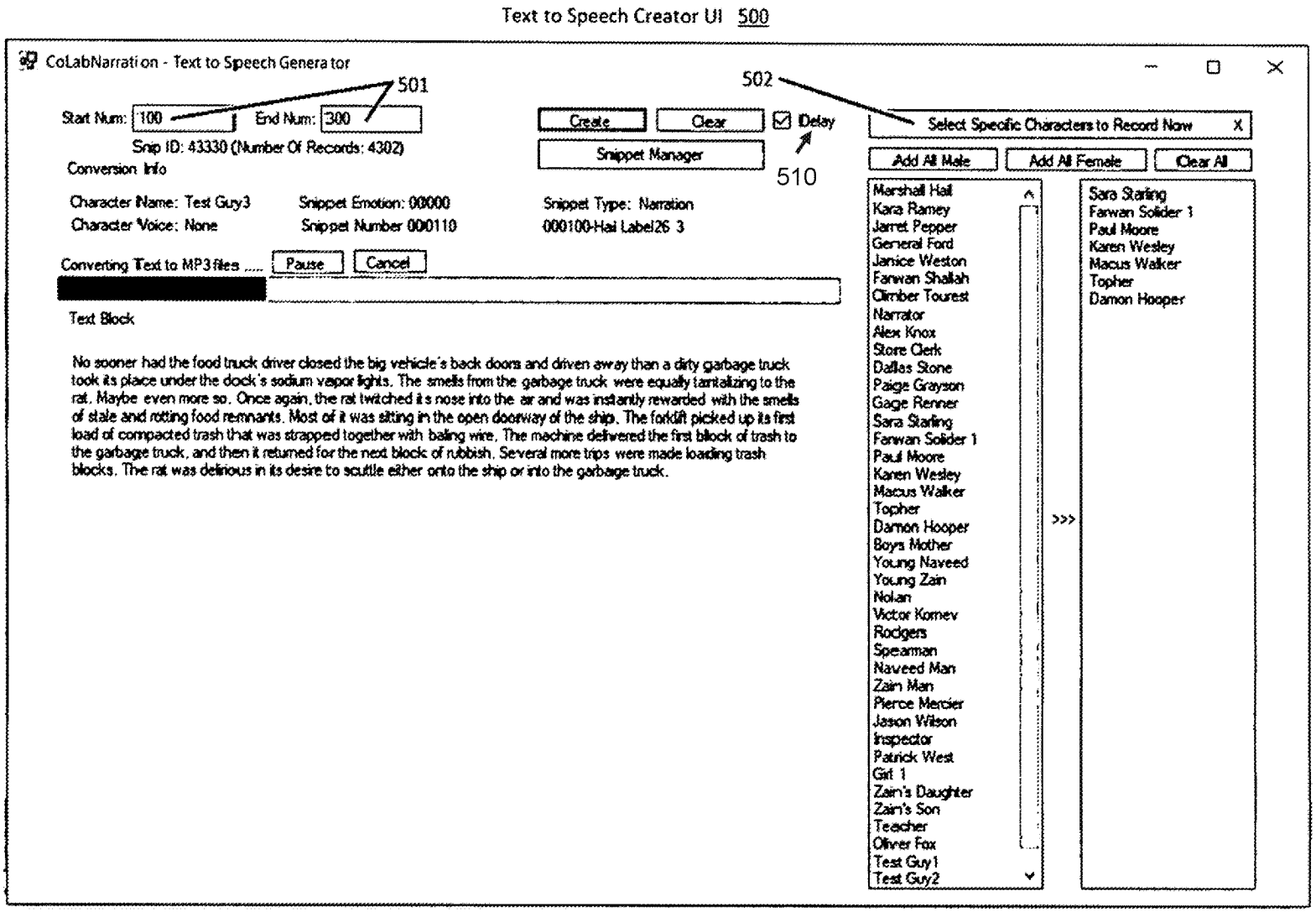
FIG. 5 is a screen shot of the Text-to-Speech Generator UI in the CoLabNarration software.

FIG. 5 is a screen shot of the Text-to-Speech Generator UI 500 in the CoLabNarration software 10 (FIG. 16). This figure illustrates the user interface (UI) process for sending text to an API engine 1606 (FIG. 16) and receiving audio files 1608 (FIG. 16) in return.

In FIG. 5, the Text-to-Speech Generator UI 500 is an illustration of the methods and selections presented to the author in order to virtualize snippets. This text-to-speech Generator UI 500 allows the author to select a span of snippet IDs that will be virtualized in Start Num and End Num fields 501 as well as selecting specific characters and/or combination of characters to be virtualized. Using the character selector 502 of the Text-to-Speech Generator UI 500, the author also has the option of selecting all male characters, all female characters, or a combination of both or individual characters. The data elements that are displayed on this screen change as each snippet is virtualized. From the user's perspective, the Text-to-Speech Generator UI 500 of the module is simple, however the backend coding and collection parameters from the Snippet and Character files and then passing that data to the text-to-speech API, is very complicated. Making this process even more complicated is the fact that each text-to-speech vendor requires different formats and API keys in order to virtualize snippets. All of these complex tasks are performed behind the scenes and not exposed to the author.

FIG. 6 is an actual screen shot of the Concatenate Audio UI 600 that represents the process of concatenating all the audio files into a contiguous audiobook. This figure illustrates the user interface (UI) process that assembles (potentially) thousands of audio files into a coherent audiobook that is ready for sale.

In FIG. 6, the Concatenate Audio UI 600 is an illustration of the method used to create the finished audiobook. The author is walked through two steps in order to run this module. The Concatenate Audio UI 600 includes a version selection 601, which allows the author to select the version of audio they wish to make. If, for example, Version 2 is selected, then every time the process runs into a duplicate snippet number, the second audio file is used instead of the first audio file. Each time the author duplicates a snippet record; the version number is incremented and is displayed in the dropdown box in the Concatenate Audio UI 600. The only other choice the author must make is to check or uncheck the "Mixed Recorded and Virtual Voices" 602 of the Concatenate Audio UI 600. If this box is checked then the process uses both human recorded narration, as well as text-to-speech audio. If both a human narrated and virtual audio file exist, then the human narrated audio file is used and the virtual audio file is omitted in the build. Prior to concatenating the audio files, a continuity scan is run that verifies that each snippet has an audio file associated with it. If not, an error message is generated and the author will need to record the orphaned snippets in order to build the audiobook.

Figure 7:
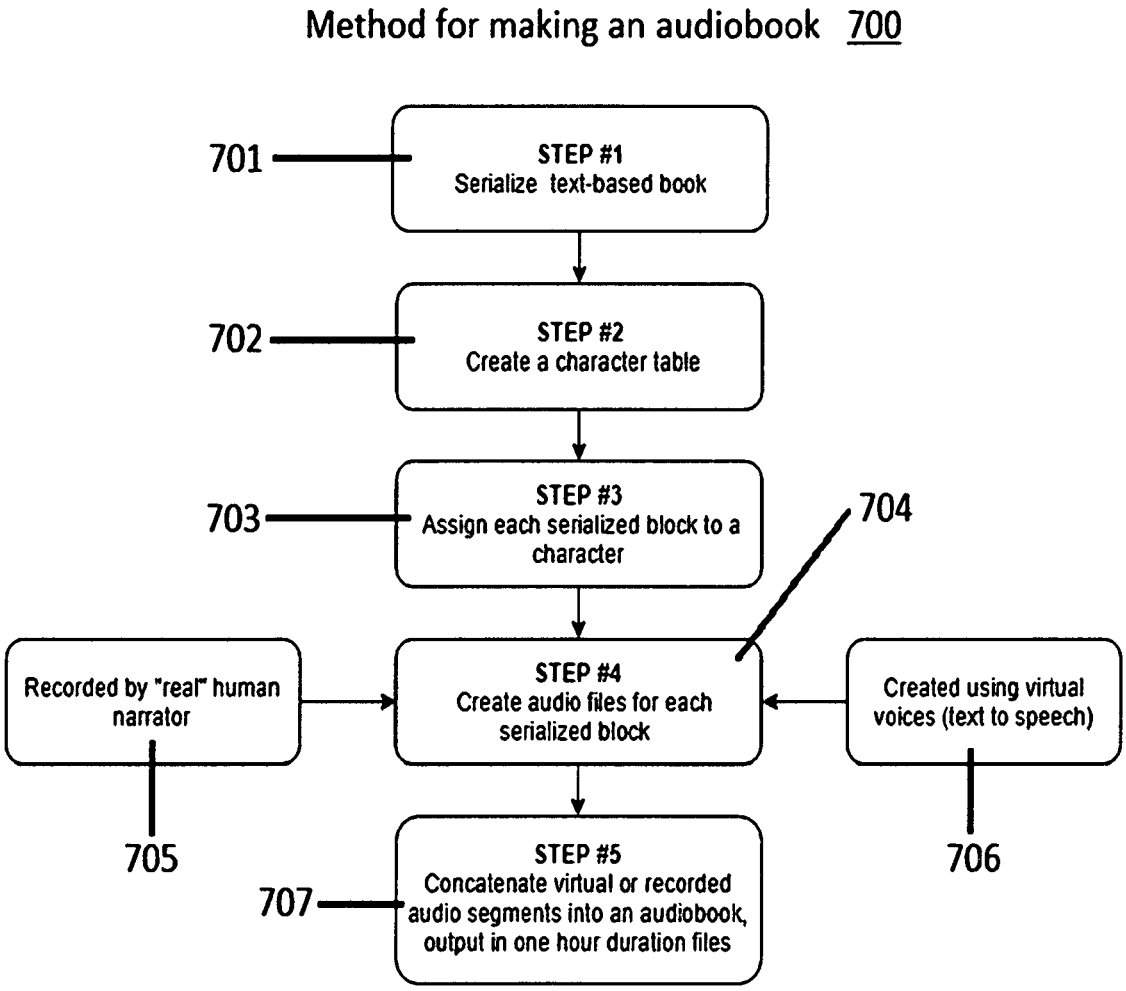
FIG. 7 is a flow diagram depicting a step-by-step process of creating an audiobook using the CoLabNarration method/process.

FIG. 7 is a flow diagram depicting a step-by-step process of creating an audiobook using the CoLabNarration method/process.

In FIG. 7, the Method 700 for Making an Audiobook depicts the five-step CoLabNarration process. STEP #1 701 is the serialization of the text book. Along with this method, proprietary algorithms automatically assign snippets to the appropriate character, as well as assign Snip Types to each snippet. For each character assigned to a snippet a default record of that character is created in the character table. The end result of this process is a data file that can be read by the CoLabNarration application. STEP #2 702 represents that creation of a character dataset or file. Using a manual process, the user can use the Character Manager UI 200 (FIG. 2) to modify, add or delete characters from the project. Within the module, colors can be assigned to represent characters, virtualize voices are assigned to characters, as well of personal information about each character. STEP #3 703 represents work that is performed in the Snippet Manager UI 300/400 (FIGS. 3, 4A and 4B). Within this module, the author can assign snippets to characters, correct snippets that are assigned to the wrong character (from STEP #1), as well as assign the appropriate Snip Type to each snippet. The interface also allows the human narrator a recording interface (recording mode #2) as well as the ability to assign emotions to each snippet. Once all the additions and modifications have been made in the Snippet Manager UI 300/400 (FIGS. 3, 4A and 4B), then the next step can continue. STEP #4 704 is the module that performs the text-to-speech operations with a $3^{rd}$ party API. Within this module, the author can incorporate virtualized voices into the project by running the Text to Speech interface. When this process is run it sends a SSML text stream to the API engine, which returns a virtualized audio file. This process also itemizes each audio file transaction and associates the audio file with the snippet file by giving the audio file the same snippet prefix number. These audio files may consist of audio recorded by a human narrator 705, or virtualized audio files 706, or a combination of both. STEP #5 707 represents the module that concatenates all the audio files into a complete audiobook. Within this module, several audio file processing tasks take place. The first action preformed removes all silent segments in the front and the back of the file (at 902 of FIG. 9). This sets both the lead beginning/end silence of human recorded audio files and the lead beginning/end silence of virtualize audio files. This task creates a baseline for all audio files and is vital to the next task. The second significant action the module performs is to analyze the previous, current, and next text snippets and determines the amount of silence to be added to each snippet. The last task of the concatenation module is to break each audiobook file at the one-hour mark, which is typically the format that publishers desire.

Figure 8:
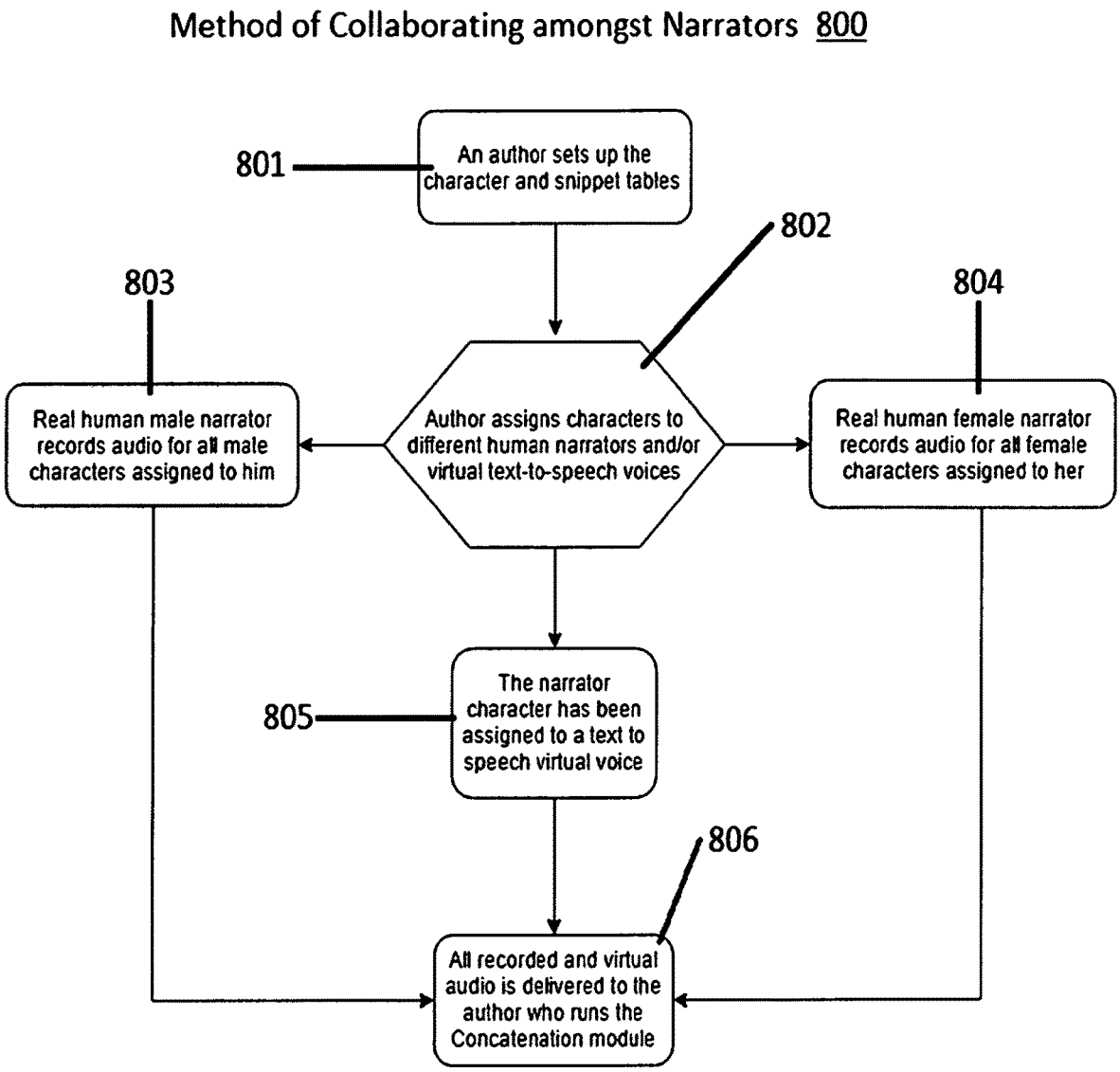
FIG. 8 is a flow diagram depicting the collaboration process of creating an audiobook using the CoLabNarration method/process.

FIG. 8 is a flow diagram depicting the collaboration process 800 of creating an audiobook using the CoLabNarration method/process.

In FIG. 8, Method 800 of Collaborating Amongst Narrators depicts the method in which an author may collaborate with multiple human narrators within a single CoLabNarration project. Once the author has finalized modification on both the character and snippet files, at 801, then the author can use the Project Sharing UI 1400 (FIGS. 14A and 14B), which assigns specific snippets to specific human narrators, at 802. Once the narrator has received the project, he/she can record all the characters that are assigned to them, at 803 and 804. This illustration shows that the narration Snip Typed will be created via text-to-speech, at 805. The final step in the sharing process involves the narrators exporting the project and the author importing the content back into the project, at 806.

Figure 9:
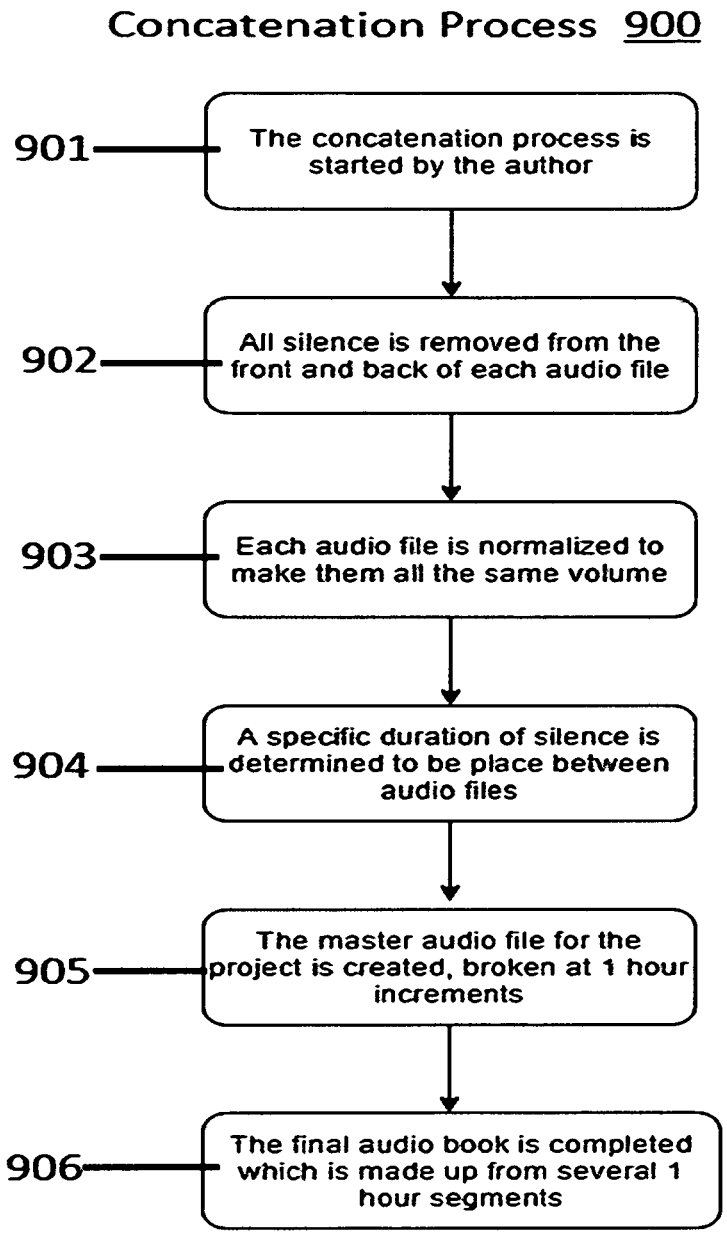
FIG. 9 is a flow diagram depicting the process of concatenating all the audio files into a complete audiobook using the CoLabNarration method/process.

FIG. 9 is a flow diagram depicting the process 900 of concatenating all the audio files into a complete audiobook using the CoLabNarration method/process.

In FIG. 9, Concatenation Process 900 depicts the method in which the thousands of audio snippets are assembled into contiguous 1-hour segments. Using the Make an Audiobook module, the author begins the creation process 901. The first task the process addresses is the amount of silence at the beginning and end of each audio snippet. This task is essential in equalizing the lead and end of each snippet so that a predetermine amount of silence can be inserted between snippets, at 902. The next task is to normalize, at 903, each of the audio files, which increases or decreases the volume of each snippet, to create a baseline signal amplitude. This type of edit in the audio industry can also be referred to as "compressing" the audio, at 903. The next task in the process 900 analyzes the snip type and then assigns an appropriate amount of silence between snippets, at 904. For example, a longer portion of silence will be inserted between the BOOK TITLE and the AUTHORS NAME than would be inserted at the end of standard paragraph, at 904. The next task in the process 900 is to continually add the duration of each snippet added to the file until the concatenated file is approximately 1-hour in duration, at 905. At each hour of duration, a new file will be created, and the concatenation process will continue until all snippets have been concatenated into 1-hour audio files. When the process is completed, the author will have a completed audiobook broken down into several 1-hour segments, at 906. At this point, the audiobook can be submitted to a publisher for their consideration.

FIG. 10 is a flow diagram depicting the serialization process 1000 used to convert a text-based book into a serialize file used by the CoLabNarration method/process.

In FIG. 10, the Serialization Process 1000 depicts the CoLabNarration serialization process of the authors text book into a serialized file that can be used in the CoLabNarration process. The first step in the process is to analyze the text book file and to break it down into ordered text blocks that are either dialogue or narration, at 1001. In the next step, a proprietary algorithm is used to determine which snippet belongs to which character, at 1002. Any snippet that can't be paired with the character is left for the author to manually assign, at 1003. Using another proprietary algorithm, each snippet is also assigned a Snip Type, at 1004. The Snip_Type field 303 defines what type of snippet is represented and is also used in the concatenation process 900. A CoLabNarration file is created, that when imported, will create a new CoLabNarration project, at 1005. Possible Snip Typed values include: Book Title, Publishing Information, Dedication, Chapter, Chapter Break, Dialogue, Narration, and Book End.

FIG. 11 is a screen shot depicting the first of two recording modes that is presented to the human narrator via a Recording Mode #1 UI 1100.

In FIG. 11, the Recording Mode #1 UI 1100 is one of the two recording modes offered to human narrators who record snippets. Recording Mode #1 US 1100 formats the snippets in a manner to mirror the original text file (book). Since this view is formatted in a traditional manner, that in which traditional narrators are accustomed, this format/mode might be popular with experienced narrators. The character colors are incorporated in this mode. For example: the narrator is not assigned a color, so the narrator color is black and white, which still individualizes the snippet from others in the same paragraph, denoted at 1001. In this example, black over gold could designate one character, denoted at 1002, while white over blue could designate another character, denoted at 1003.

FIG. 12 is a screenshot depicting the second of two recording modes that is presented to the human narrator via the Recording Mode #2 UI 1200.

In FIG. 12, the Recording Mode #2 UI 1200 is a screen shot of the Snippet Manager UI 300. This screen would constitute the second mode of recording audio. In this mode, the author is presented a serialized version of the text, broken down into individual snippets. In this mode, the narrator has the option of recording all audio snippets for just one character, or record line after line by moving down the data grid. In this illustration, each snippet 1201 is recorded in a line by line method.

Figure 13B:
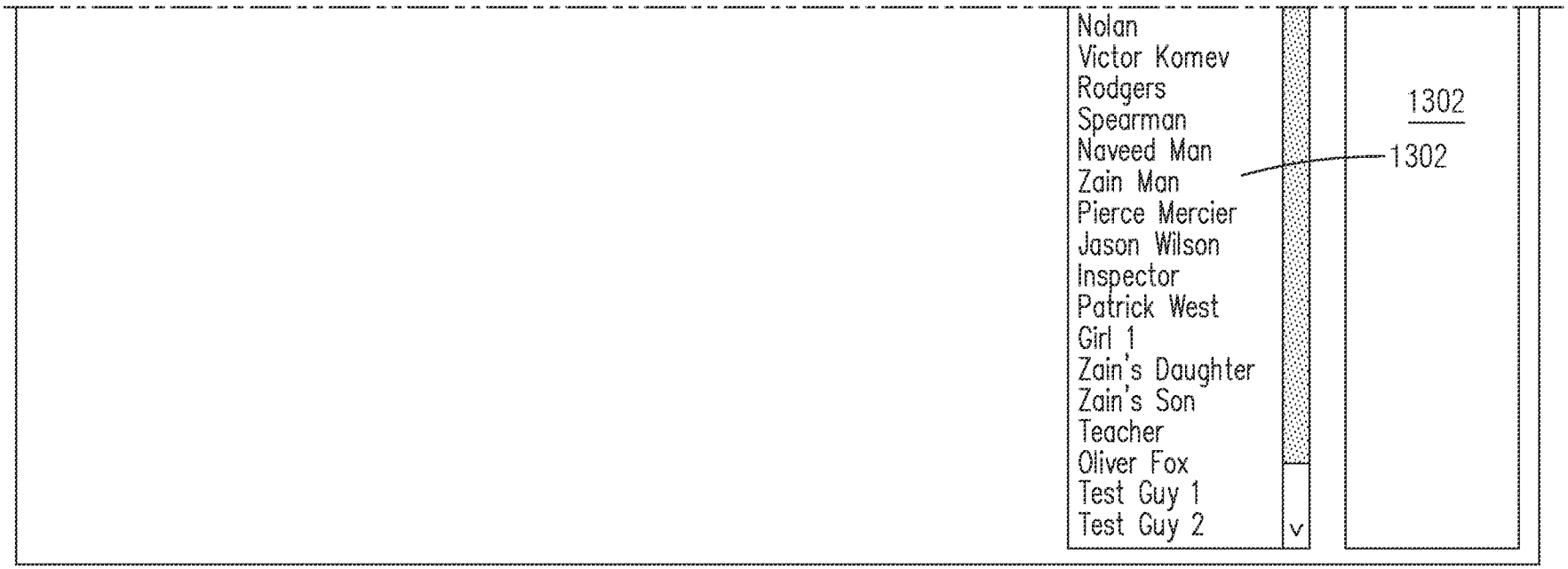

FIGS. 13A and 13B illustrate the Listen to Audio user interface (UI) process that allows the user to listen to audio that has already been recorded or virtualized used by the CoLabNarration method/process.

In FIGS. 13A and 13B, the Listen to Audio UI 1300 is a screen shot of the process that allows authors and narrators to review audio that has been recorded or virtualized. This process mimics the concatenation process, with the exclusion of silence being added to separate the snippets. This process could be considered a method of listening to the raw audio, audio which has not been optimized or normalized. This Listen to Audio UI 1300 allows the user to listen to all audio between the Start snippet number and the End snippet number, denoted at 1301. The user can also listen to audio by selecting the character they want to hear from dropdown list 1302. If a list of characters has been selected, then each character is read when it is encountered in snippet file 1304. This Listen to Audio UI 1300 may be needed for a narrator to listen to a back and forth conversation between characters, thus gauging their own performance. To start the process, the user selects a combination of character and snippet number and clicks on the Listen button 1303 of the Listen to Audio UI 1300.

Figure 14B:
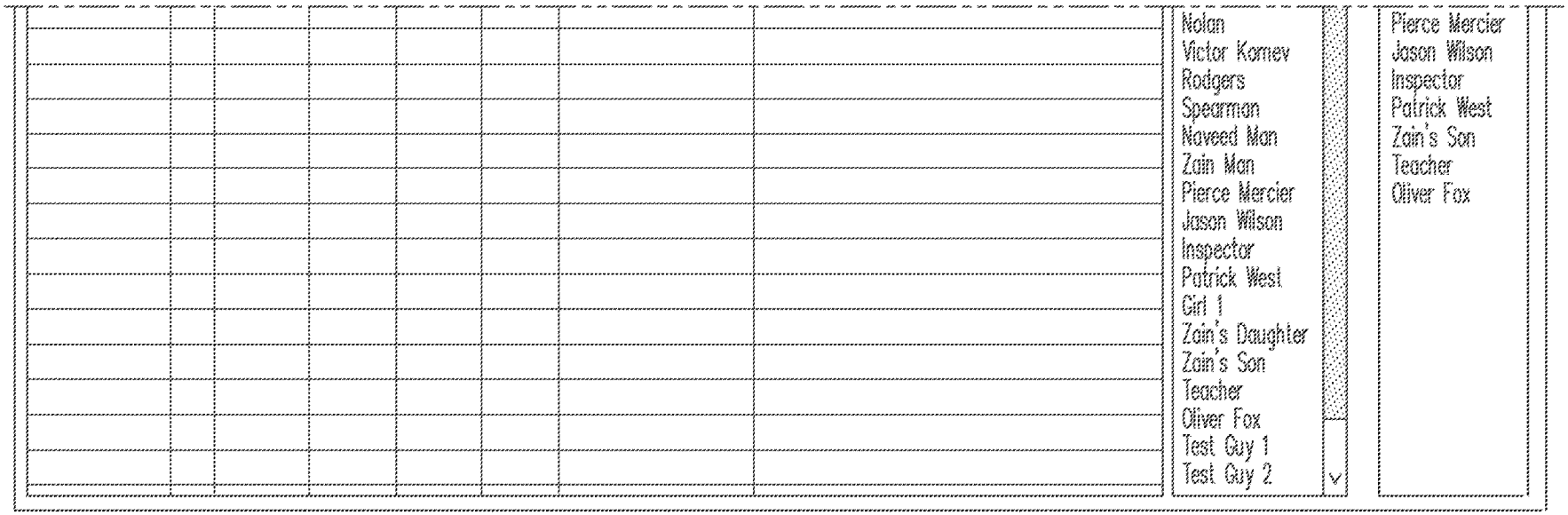

FIGS. 14A and 14B illustrate the Project Sharing with a Narrator user interface (UI) 1400 that allows the author to securely share a project with multiple narrators.

In FIGS. 14A and 14B, the Project Sharing with a Narrator UI 1400 is a screen shot of the process that allows to an author to share the project with multiple narrators. The list of narrators used in the project are contained in the narrator file of the Project Sharing UI 1400. Fields in the narrator file are Narrator Name field 1401 showing the name of the narrator for hire; the sex field 1402 of the narrator, male or female; the voice type field 1403 of the narrator, which describes the tone of the narrator's voice; the Voice Age field 1404 that shows the actual age of the narrator or the age in which their voice sounds. The Language field 1405 indicates the language or languages the narrator can speak. The Accent field 1406 shows what type of Accent the narrator has (for example, the author may want a narrator who can speak in a Texan accent). If this were the case, then the text in this field would be "Texan". The Email Address field 1407 is the email address of the narrator and is used to email the project to the narrator. The ACX URL field 1409 is a link that each narrator has if they are a member of the Audible ACX list of narrators. This link allows the author to jump directly to this narrator's page on the ACX platform and listen to audio samples the narrator has submitted. All the characters in the project are shown in the left list box 1411 and each time the author clicks on a name, that name is added to right list box 1412. The left box represents the characters that have been assigned to the narrator "Michael Reaves". The author is required to enter a mixed character code in the Unlock Code text box 1413. This code is included within the email the narrator receives when a project is emailed to him/her. Upon the import of the project into the narrators CoLabNarration software, they are prompted to enter this code. In the background, all characters are locked to recording except those that have been assigned to the narrator, protected by the Unlock Code. After the author has selected characters for a specific narrator, by clicking the Send button 1410, an email is sent to the narrator containing links, codes, and general information they will require.

FIG. 15 illustrates the email 1500 of a sharing process and illustrates the method in which a narrator would receive and import a CoLabNarration project via computing device 20 (FIG. 16).

In FIG. 15, Email 1500 that a Shared Narrator Receives is an example email that illustrates the method an author shares their project with a narrator. Within this email 1500, the project name and author are represented in the Subject line 1501. During the sharing process, the zipped project file is uploaded to an AMAZON® S3 bucket and associated with a download link 1502 to file. Additionally, a brief block of Project information 1503 is sent that provides the narrator with the basic information required. Finally, a link 1504 to the full production version of the CoLabNarration software 10 (FIG. 16) is present, so if they are a narrator new to this process, they can download the software.

FIG. 16 illustrates a computing device 1602 with a screen 1604 and uploads the project file. The narrator computing device 20 receives the email 1500.

Figure 17:
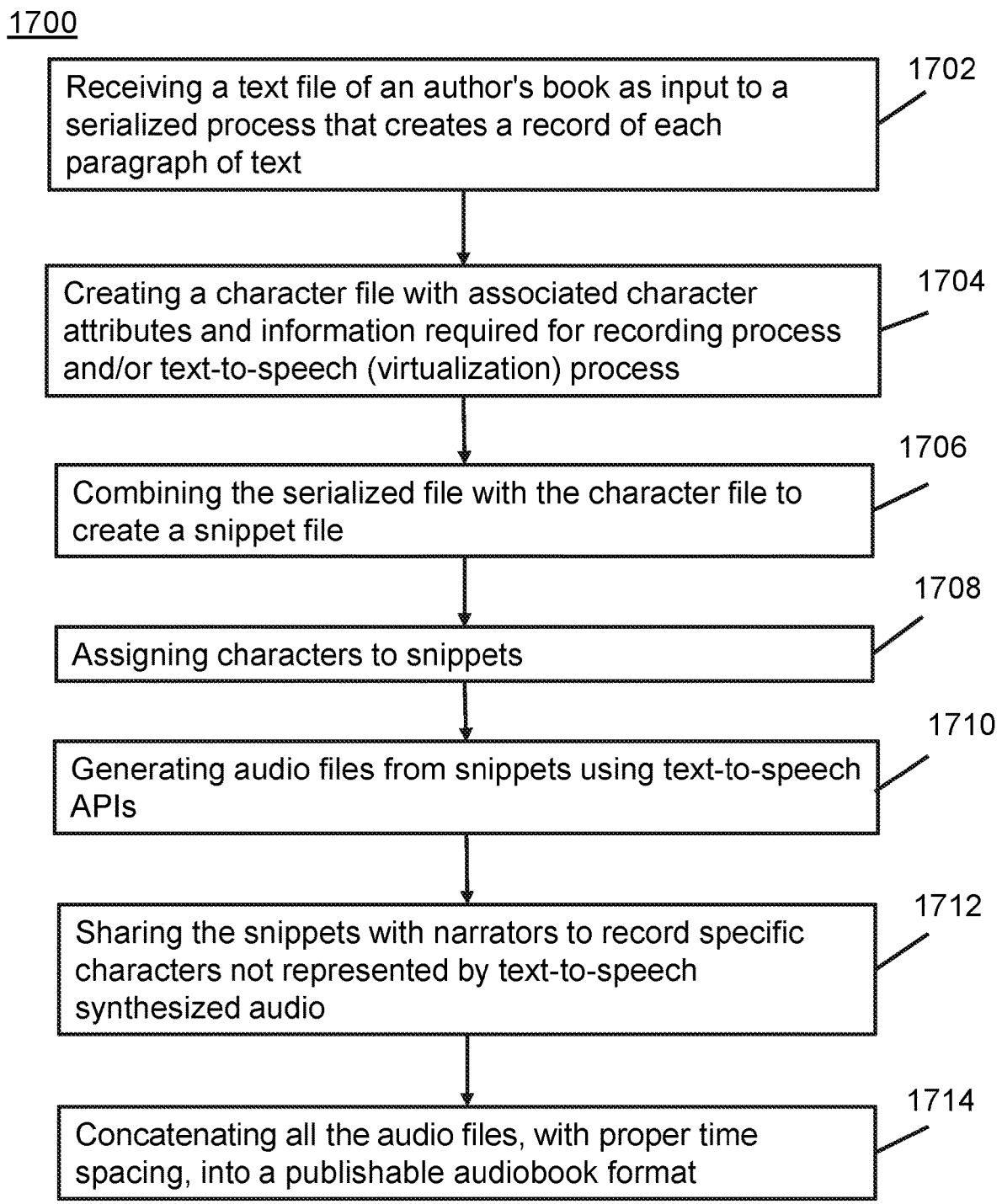
FIG. 17 illustrates a method for generating an audiobook from a text file.

FIG. 17 illustrates a method 1700 for generating an audiobook from a text file. The method 1700 includes (at 1702) receiving a text file of an author's book as input to a serialized process that creates a record of each paragraph of text. The method 1700 includes (at 1704) creating a character file with associated character attributes and information required for the recording process and or virtualization process. For example, the created character file identifies the characters and their attributes, such as age, race, sex, personality, physical build, voice qualities, human narrator or synthesized audio. The method 1700 includes (at 1706) combining the serialized file with the character file to create a snippet file.

The method 1700 includes (at 1708) assigning characters to snippets; and (at 1710) generating audio files from snippets using text-to-speech APIs. The snippets of text are assigned to a character, can be edited, and audio played back. The method 1700 includes (at 1712) sharing snippets with narrators to record specific characters not represented by text-to-speech synthesized audio; and (at 1714) concatenating all audio files from snippets, with proper time spacing, into a publishable audiobook format. The snippets are concatenated, and audio files are created through links to text-to-speech API processes. The snippets are concatenated and shared with a human narrator and received back into the CoLabNarration process as audio files.

The audio files from all text-to- speech and/or human narration are concatenated, time spaced corrected for playback, and a set of one or more hour long audio book formatted files are created.

The invention claimed is:

1. A method for generating an audiobook from a text file of a book, comprising:

receiving the text file of the book as input to a serialized process;

creating, by the serialized process, data elements of each paragraph of text of the book;

creating a character data file with user-selectable character attributes and information for each character of a plurality of character entries of the book;

displaying, in a character user interface (UI), the user-selectable character attributes and the information for each character of the plurality of character entries of the book in the character data file;

receiving user entry data associated with the user-selected character attributes, using the character UI, wherein at least one first user entry data includes user-selected character attributes for selected virtual voice entry for a respective first one character and at least one second user entry data includes user-selected character attributes for at least one selected real narrator, each real narrator associated with a different assigned character;

combining, in a snippet manager UI, the character data file with the data elements, the data elements being snippets of the book;

assigning to the snippets, using the snippet manager UI, corresponding character entries associated with the plurality of character entries of the book;

generating, using a text-to-speech generator UI, audio files for those snippets having the selected virtual voice entry, the text-to-speech generator UI using a text-to-speech application programming interface (API);

sharing electronically those snippets of the book having the at least one selected real narrator to record the different assigned character;

receiving recorded audio files of those snippets recorded by the at least one selected real narrator; and concatenating the generated audio files and the recorded audio files, with time spacing, into a publishable audiobook format.

2. The method of claim 1, wherein the character UI includes a plurality of character data entry fields, the plurality of character data entry fields comprising an age field, a race field, a sex field, a personality field, a physical build field, and voice qualities field.

3. The method of claim 1, further comprising:

receiving, using the snippet manager UI, a user-selected entry for a selected one snippet associated with a snippet emotion, the snippet emotion conveying an emotion.

4. The method of claim 1, further comprising:

listening by a user, using a Listen to Audio UI, at least one of received recorded audio files.

5. The method of claim 1, wherein a selected snippet comprises book text of a first version; and further comprising:

receiving, using the snippet manager UI, user-edited text of the selected snippet, wherein the concatenating the generated audio files and the recorded audio files, into the publishable audiobook format includes forming a first version of a publishable audiobook using the selected snippet comprising the book text of the first version, receiving, using the snippet manager UI, information associated with a created second version of the selected snippet with the user-edited text, and concatenating the generated audio files and the recorded audio files, into a second version publishable audiobook format by using the second version of the selected snippet.

6. The method of claim 5, further comprising:

providing to a user, using a Listen to Audio UI, an audio file associated with the first version of the selected snippet; and providing to the user, using the Listen to Audio UI, an audio file associated with the created second version of the selected snippet.

7. The method of claim 5, further comprising:

prior to concatenating, filtering each recorded audio file to eliminate silent segments at a beginning or at an end of each recorded audio file.

8. The method of claim 5, wherein during concatenating, inserting a duration of silence between the generated audio files and the recorded audio files.

9. The method of claim 1, wherein each snippet is assigned an XML identifier (ID) and includes snippet data entry fields for one or more of:

book text;

language;

snippet version number;

snippet emotion; and character voice.

10. The method of claim 9, further comprising:

displaying, using the snippet manager UI, information associated with the snippet data entry fields;

receiving, using the snippet manager UI, an edit or change to one of the book text, the language, the snippet version number and the character voice of a selected snippet; and forming, using the snippet manager UI, a new snippet version associated with the received edit or change, the new snippet version having a different snippet version number and a duplicate snippet XML ID of the selected snippet.

11. The method of claim 10, wherein:

each generated audio file and each recorded audio file are associated with a corresponding different snippet XML ID; and further comprising:

during the concatenating:

displaying, using a concatenating UI, selectable snippet version numbers, in response to identifying the duplicate snippet XML ID;

receiving selection of a respective one snippet version number associated with the snippet having the duplicate snippet XML ID; and concatenating the generated audio files and the recorded audio files according to a serialized snippet XML ID format using the selected snippet version number for any duplicate snippet XML ID.

12. A method for generating an audiobook from a text file of a book, comprising:

creating, by a serialized process, data elements of each paragraph of the text file;

displaying on a screen, in a character user interface (UI), user-selectable character attributes and information for each character of a plurality of character entries of the book in a character data file;

receiving user entry data associated with the user-selected character attributes, using the character UI, wherein at least one first user entry data includes user-selected character attributes for selected virtual voice entry for a respective first one character and at least one second user entry data includes user-selected character attributes for at least one selected real narrator;

combining, in a snippet manager UI, the character data file with the data elements, the data elements being snippets of the book;

generating, using a text-to-speech generator UI, audio files for those snippets having the selected virtual voice entry, the text-to-speech generator UI using a text-to-speech application programming interface (API);

receiving recorded audio files of those snippets recorded by the at least one selected real narrator; and concatenating the generated audio files and the recorded audio files, with time spacing, into a publishable audiobook format.

13. The method of claim 12, wherein the character UI includes a plurality of character data entry fields, the plurality of character data entry fields comprising an age field, a race field, a sex field, a personality field, a physical build field, and voice qualities field.

14. The method of claim 12, further comprising:

receiving, using the snippet manager UI, a user-selected entry for a selected one snippet associated with a snippet emotion, the snippet emotion conveying an emotion.

15. The method of claim 12, wherein a selected snippet comprises book text of a first version; and further comprising:

receiving, using the snippet manager UI, user-edited text of the selected snippet, wherein the concatenating the generated audio files and the recorded audio files, into the publishable audiobook format includes forming a first version of a publishable audiobook using the selected snippet comprising the book text of the first version, receiving, using the snippet manager UI, information associated with a created second version of the selected snippet with the user-edited text, and concatenating the generated audio files and the recorded audio files, into a second version publishable audiobook format by using the second version of the selected snippet.

16. The method of claim 15, further comprising:

providing to a user, using a Listen to Audio UI, an audio file associated with the first version of the selected snippet; and providing to the user, using the Listen to Audio UI, an audio file associated with the created second version of the selected snippet.

17. The method of claim 15, further comprising:

prior to concatenating, filtering each recorded audio file to eliminate silent segments at a beginning or at an end of each recorded audio file.

18. The method of claim 15, wherein during concatenating, inserting a duration of silence between the generated audio files and the recorded audio files.

19. The method of claim 12, wherein each snippet is assigned an XML identifier (ID) and includes snippet data entry fields for one or more of:

book text;

language;

snippet version number;

snippet emotion; and character voice.

20. The method of claim 19, further comprising:

displaying, using the snippet manager UI, information associated with the snippet data entry fields;

receiving, using the snippet manager UI, an edit or change to one of the book text, the language, the snippet version number and the character voice of a selected snippet; and forming, using the snippet manager UI, a new snippet version associated with the received edit or change, the new snippet version having a different snippet version number and a duplicate snippet XML ID of the selected snippet.

* * * * *